US005694703A

United States Patent [19]

Diaz

[11] Patent Number: 5,694,703

[45] Date of Patent: Dec. 9, 1997

[54] SLIP-ON COVER FOR SHOES AND BOOTS FOR PROTECTION AGAINST HIGH SPEED CUTTING IMPLEMENTS

[75] Inventor: Vincent Diaz, Abingdon, Md.

[73] Assignee: Sawjammer, LLC, Abingdon, Md.

[21] Appl. No.: 541,181

[22] Filed: Oct. 11, 1995

[51] Int. Cl.[6] ..... A43B 3/16; A43B 3/18; A43B 3/20

[52] U.S. Cl. ..... 36/7.1 R; 36/7.2; 36/7.7; 36/72 R

[58] Field of Search ..... 36/7.2, 7.7, 7.5, 36/7.1 R, 72 R, 73, 74, 7.6

[56] References Cited

U.S. PATENT DOCUMENTS

| | | | |
|---|---|---|---|
| D. 336,972 | 7/1993 | Diaz | D2/267 |
| 536,812 | 4/1895 | Mabee . | |
| 806,439 | 12/1905 | Smyth . | |
| 1,037,201 | 9/1912 | Brown et al. . | |
| 1,132,159 | 3/1915 | Carr | 36/72 R X |
| 1,187,778 | 6/1916 | Paskett | 36/7.6 X |
| 1,386,028 | 8/1921 | Roe | 36/7.6 |
| 1,458,497 | 6/1923 | Perkins | 36/7.6 |
| 1,663,381 | 3/1928 | McKinley . | |
| 1,831,851 | 11/1931 | Everett . | |
| 2,193,943 | 3/1940 | Shea | 36/7.6 X |
| 2,307,699 | 1/1943 | Moen | 36/7.5 |
| 3,716,932 | 2/1973 | Pakulak | 36/72 R |
| 4,069,599 | 1/1978 | Alegria | 36/7.2 |
| 4,638,574 | 1/1987 | Roda | 36/7.2 |
| 5,172,493 | 12/1992 | Diaz | 36/2 R |
| 5,251,386 | 10/1993 | Diaz | 36/2 R |
| 5,272,822 | 12/1993 | Diaz | 36/2 R |
| 5,359,789 | 11/1994 | Bell | 36/7.6 |

FOREIGN PATENT DOCUMENTS

| | | |
|---|---|---|
| 234282 | 5/1911 | Germany . |
| 370873 | 5/1939 | Italy . |
| 79329 | 11/1918 | Switzerland . |
| 2 219 727 A | 12/1989 | United Kingdom . |

OTHER PUBLICATIONS

U.S. Department of Agriculture Forest Service Specification 6170–4D, Jan. 1989.

Husqvarna Forest & Garden Company, 9006–J Perimeter Woods Drive, Charlotte, NC 28216, Catalog 1995, pp.12–13.

Federal Register, vol. 60, No. 174, Sep. 8, 1995, pp. 47022–47037.

*Primary Examiner*—Ted Kavanaugh

*Attorney, Agent, or Firm*—Leonard Bloom

[57] ABSTRACT

A slip-on cover for shoes and boots to protect the feet and ankles of a person using a high speed cutting device. The protective cover has a sole member which is in contact with the sole of the shoe/boot and an upper member which covers the upper portion of the shoe/boot. The upper member is flexible and is formed of multiple layers including a high modulus fiber lining. The upper member is attached to the sole member. The sole member is removably fastened to the shoe/boot. The sole member may be a full sole or a partial sole.

25 Claims, 8 Drawing Sheets

SLIP-ON COVER FOR SHOES AND BOOTS FOR PROTECTION AGAINST HIGH SPEED CUTTING IMPLEMENTS

BACKGROUND OF THE INVENTION

The present invention relates to a flexible protective cover for shoes and boots and more particularly to a cover made of fibers which bind a chain saw, and removably slips on over shoes and boots worn by a user of the chain saw.

Chain saws and other high speed cutting implements are widely used commercially and residentially. Due to the efficiency of the cutting implements and the time savings which are obtained, the cutting implements are gaining even greater use. As of 1995, there are more than twenty million chain saws in use in the United States. An average of 1.7 million new chain saws are sold annually. However, the chain saw can be an unforgiving and even lethal tool causing severe injury or death in the hands of an uninformed, unwary or inadequately protected operator. From 1980 to 1990, according to NIOSH, there were 6,400 on the job accidents that resulted in a fatality and 1,400 of these involved the timber industry. Approximately 95% of timber harvesting in the United States is being performed by independent contractors. On average, these contractors are paying workmen's compensation rates of $50 per $100 of payroll. In 1993, the U.S. Consumer Product Safety Commission received reports of 40,198 injuries due to chain saws of which 3,330 were injuries in the foot area. The Department of Labor, Occupational and Health Administration recognizes the problems caused by chain saws in the logging industry and has published a rule that requires an employer to assure that each employee who operates a chain saw, wear foot protection that is constructed with cut-resistant material which will protect the employee against contact with a running chain saw (Federal Register Vol. 60, No. 174, Sep. 8, 1995, pages 47022–47037).

Although many gaiter type devices are known to protect the feet and ankles of wearers, most of these are not effective against high speed cutting implements. A protective chaps type garment is available to protect users against chain saw injuries to the lower torso and legs. This garment is described in Specification 6170-4D, January 1989 for Chaps, Chain Saw published by the U.S. Department of Agriculture Forest Service. However, this garment does not protect the feet of chain saw users. U.S. Pat. Nos. 5,172,493; 5,251,386; 5,272,822 and Des. 336,972 issued to the applicant disclose gaiter type protective covers for shoes which provide protection from chain saws. Also, U.K. Patent Application No. 2,219,727A published Dec. 20, 1989 discloses a gaiter type device for use with chain saws.

However, these gaiter type devices are either permanently attached to the wearer's shoe, are not easily attached and removed, or are not securely held on the wearer's shoe. There is a need for a protective cover for shoes and boots which the wearer can easily and rapidly slip on over the shoes and boots and which can be securely held thereon so as not to be dislodged by the force of the chain saw.

The applicant is aware of U.S. Pat. No. 806,439 for a protector for shoes to prevent the shoe from becoming soiled which is strapped on the shoe but does not slip-on the shoe. U.S. Pat. No. 1,037,201 discloses an overshoe, which fits over the front portion of a shoe and is capable of being repaired. A shoe protector which has a sole and side flaps which lace together over the top of the shoe is disclosed in U.S. Pat. No. 1,663,381. U.S. Pat. No. 1,831,851 discloses a non-slip overshoe which is strapped to the shoe and is useful in golfing and hunting. A sandal-like overshoe for bowling is disclosed in U.S. Pat. No. 2,307,699. A slipper-like shoe cover with a metal toe cap is disclosed in U.S. Pat. No. 3,716,932. A protective cover for the shoe of a drummer which is made from a single sheet of leather is disclosed in U.S. Pat. No. 4,069,599. U.S. Pat. No. 4,638,574 discloses a shoe protector with a metal toe cap.

Despite the existence of these devices, there still exists a need for a simple, easily attached protective cover for shoes and boots which provides adequate protection against high speed cutting implements.

BRIEF SUMMARY OF THE INVENTION

It is a primary object of the present invention to protect the user of high speed cutting devices, such as chain saws, from serious injury by providing protection for the feet and ankles.

It is a further object of the present invention to provide a slip-on cover which is simply and rapidly placed over the user's shoes and boots and secured in place so as to preclude separation from the shoe and boot when contacted by a high speed cutting device.

In accordance with the teachings of the present invention, there is disclosed a slip-on cover to protect feet and ankles of a person using a high speed cutting device. The slip-on cover is disposed over a shoe having a toe, an instep, a heel, a back, a sole surface, an outer side and an inner side. The slip-on cover includes a sole member having an inner surface and an upper member attached to the sole member. The upper member is flexible and formed of multiple layers including an outer layer, an inner layer and a high modulus fiber lining means therebetween. The high modulus fiber lining means jams the high speed cutting device in the event the high speed cutting device is brought in contact with the slip-on cover. The upper member has a toe portion, an instep, an outer side and an inner side, the inner side having a rearwardly extending tab formed thereon. Quick-release fastening means are provided between the tab and the outer side of the upper member for securing the sides of the upper member around the back of the shoe. The shoe is received and secured within the slip-on cover such that the sole member inner surface, toe portion, instep, inner side and outer side of the slip-on cover are in contact with the respective sole surface, toe, instep, inner side and outer side of the shoe. In this manner, the slip-on cover is precluded from being separated from the shoe upon contact between the high speed cutting device and the slip-on protective cover.

The sole member may be a full sole such that when the shoe is received in the slip-on cover, contact between the sole inner surface of the slip-on cover and the sole surface and heel of the shoe extends from the toe of the shoe to the back of the shoe.

The sole member may be a partial sole such that when the shoe is received in the slip-on cover, the sole inner surface of the slip-on cover is in contact with the sole surface of the shoe to a point approximately two-thirds of the distance between the toe and the back of the shoe. This distance extends approximately to the breast of the heel which is attached to the shoe/boot.

These and other objects of the present invention will become apparent from a reading of the following specification, taken in conjunction with the enclosed drawings.

BRIEF DESCRIPTION OF THE DRAWINGS

FIG. 3 is a perspective view of the present invention laid open to receive the boot.

FIG. 4 is a perspective view showing the boot disposed in the present invention prior to securing the present invention to the boot.

FIG. 5 is a perspective view showing the straps on the present invention secured about the boot with the upper member unsecured about the back of the boot.

FIG. 6 is a perspective view showing the present invention completely attached to the boot.

DESCRIPTION

Figure 1:
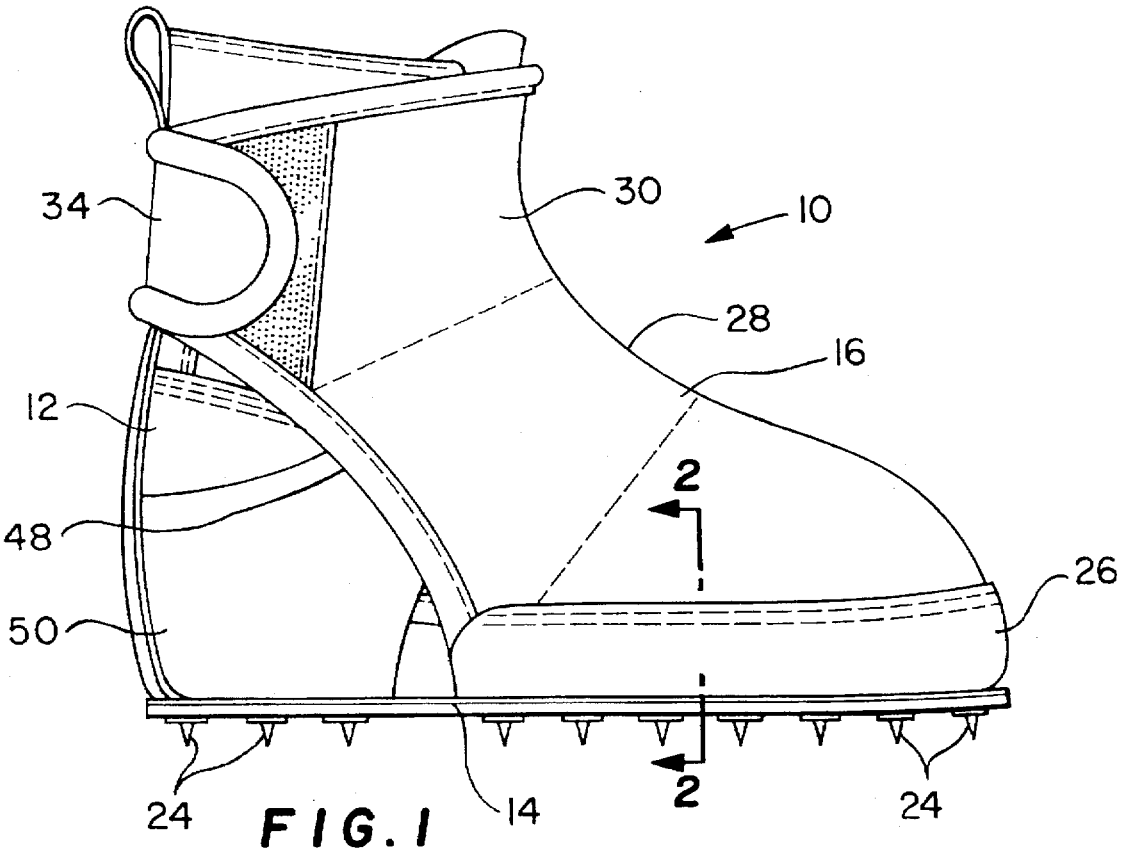
FIG. 1 is a side elevation view of the present invention worn over a boot.

Referring to FIGS. 1–6, the slip-on cover 10 is shown as worn on a typical shoe or boot 12. The slip-on cover 10 has a sole member 14 and an upper member 16 attached to the sole member 14.

The sole member 14 has an inner surface 18 and an outer surface 20. When the shoe/boot 12 is received in the slip-on cover 10, the sole surface (or tread portion) and heel of the shoe/boot 12 is in direct contact with the inner surface 18 of the slip-on cover 10. The outer surface 20 of the sole member 14 of the slip-on cover 10, preferably, has a tread pattern 22 formed thereon to facilitate traction for the user. The outer surface 20 of the sole member 14 may have a plurality of calks 24 mounted thereon for those situations where increased traction is required by the user. This could, for example, be a lumberjack who is cutting fallen timber with a chain saw and must stand on, or adjacent to, the timber. The outer surface 20 of the sole member 14 may be formed with a plurality of threaded openings to receive the cooperating threaded base of the corresponding plurality of calks 24.

The upper member 16 of the slip-on cover 10 is a flexible multiple layer fabric formed with a toe portion 26, an instep 28, an outer panel 30, and an inner panel 32. A rearwardly extending tab 34 is formed on the outer panel 30 distal from the toe portion 26. A loop means 36 is secured to the inner panel 32 distal from the toe portion 26. The loop means 36 may be a bail, or other means known to persons skilled in the art, which is dimensioned to receive therethrough the tab 34 as will be described.

The upper member 16 preferably has an outer layer 38 and an inner layer 40 with a lining means 42 therebetween. The outer layer 38 and inner layer 48 preferably are formed from a durable fabric such as canvas or nylon. The lining means 42 must be formed from a high modulus fiber, as known in the textile industry, having a tensile modulus in excess of approximately 20 g/denier. Para-aramid fiber sold by E. I. DuPont de Nemours & Co., Inc. under the registered trademark "Kevlar" has been used satisfactorily as the lining means 42. Another satisfactory lining means 42 is a high modulus polyethylene/polypropylene composite fiber which is sold by DSM High Performance Fibers BV, the Netherlands under the Registered Trademark "DYNEEMA®" and sold by Allied Corporation, Petersburg, Va. under the Registered Trademark "SPECTRA®".

In a preferred embodiment, the para-aramid lining 42 comprises both woven and non-woven fabric. At least one layer of woven para aramid is placed adjacent to at least one layer of non-woven para aramid. In an especially preferred embodiment two (2) woven para-aramid layers are in an alternating pattern with two (2) non-woven para-aramid layers. The combination of woven and non-woven lining material is preferred because the non-woven layers is stiffer and offers a more supportive base for the woven layers. This support tends to hold the woven layers in a more structured manner when engaged by the chain saw blade and permits filaments of the woven layer to be more readily disengaged from the woven layers. The filaments cause the chain saw blade to jam.

Figure 2:
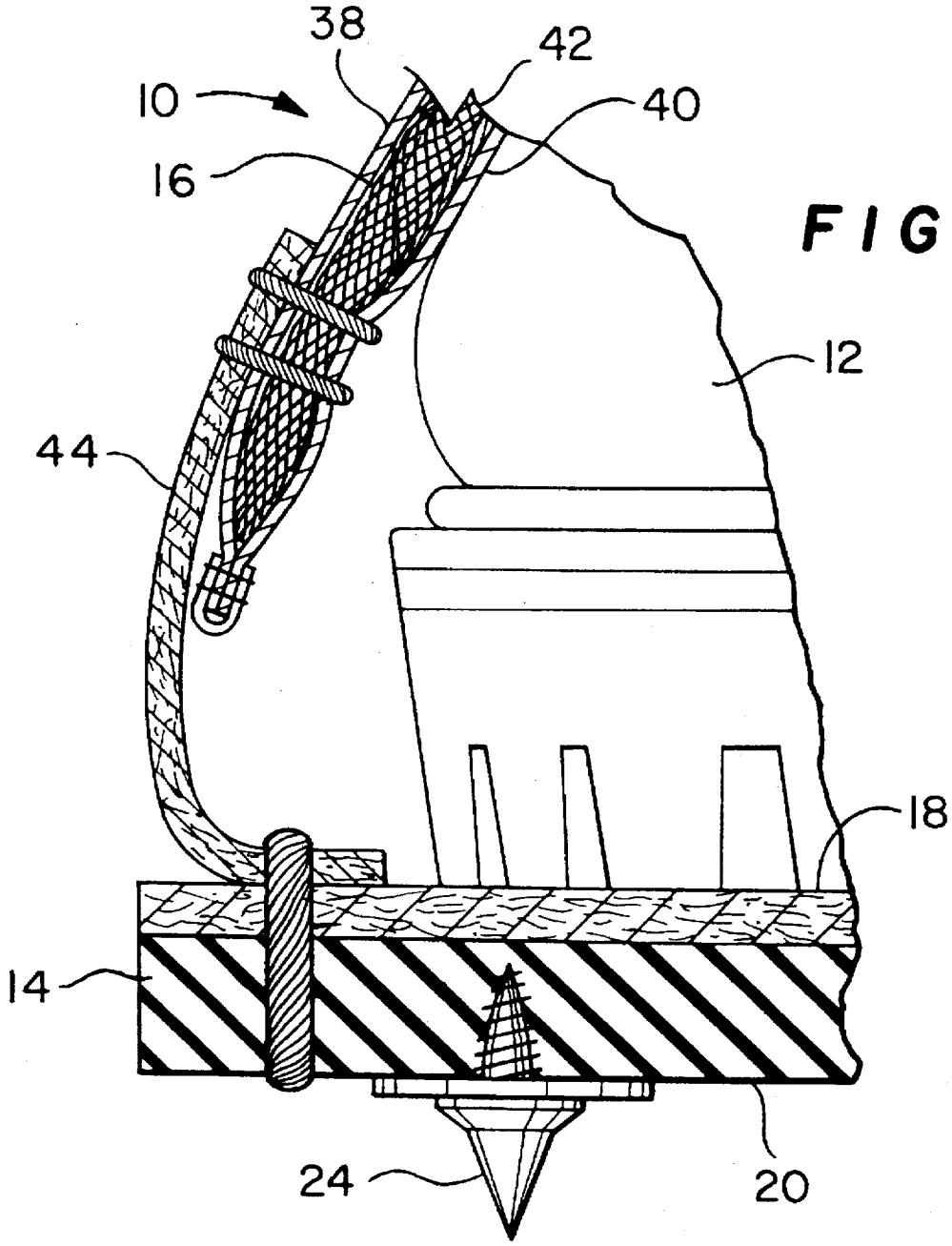
FIG. 2 is an enlarged cross-sectional view taken across the lines 2—2 of FIG. 1.

The upper member 16, preferably, further has a skirt 44 attached to the multiple layer portion; the skirt 44 extending downwardly from the toe portion (FIG. 2). The skirt 44 is securely attached, by sewing, stapling or other means, to the sole member 14. It is preferred that the skirt 44 be in contact with the inner surface 18 of the sole member 14 and be folded inwardly. In this manner, the skirt 44 is more securely attached to the sole member 14 without being subjected to external forces and avoiding snagging when worn by the user. Although the multiple layer portion may be directly attached to the sole member 14, the thickness of the multiple layers would interfere with a comfortable fit of the slip-on cover 10 and would require additional costly material. The use of the skirt 44 does not impede the movement of the boot 12 within the slip-on cover 10. Also if repairs are required to either the sole member 14 or the upper member 16, the presence of the skirt 44 permits the members to be easily separated. The skirt 44 is adjacent to the tread portion of the boot 12 so that protection afforded by the slip-on cover 10 is not compromised.

The inner panel 32 and the outer panel 30 of the cover 10 each have a respective edge 48 and 46 which curves upwardly from sole member 14 toward the back of the cover 10. The edge 46 on the outer panel 30 connects to the tab 34. The edge 48 on the inner panel 32 terminates near the loop means 36.

Referring to FIGS. 1 and 3–6, the cover 10 is shown with a full sole member 14. At the rearmost end of the sole member 14, there is an attachment means 50 to secure and release the sole member 14 to the shoe/boot 12. Preferably, the attachment means 50 has a pair of strap means 52 attached to the sole member 14 with each member of the pair having a respective end 54. The strap means 52 extend on opposite sides of the shoe/boot 12 to the instep of the shoe/boot 12. Connector means 56 are provided to connect the respective ends 54 of the strap means 52 to one another. The connector means 56 may be a buckle, a snap, a lace, hook and loop fasteners or other means known to persons skilled in the art. The connector means 56 is easily closed and opened and thereby permits the rapid securing and removal of the cover 10 from the shoe/boot 12.

It is further preferred that a strip 58 be attached to the fastening means 50 and on the back of the sole member 14 and extend upwardly substantially perpendicular to the sole member 14. The strip 58 is disposed adjacent to the back of the shoe/boot 12 when the cover 10 is disposed on the shoe/boot 12. A belt 60 is attached to the strip 52 near the top of the strip 58. The belt 60 has two opposite ends and sufficient length to permit the belt 60 to extend around the shoe/boot 12 such that the opposite ends of the belt 60 may be fastened together by a buckle, snap, lace or hook and loop. This belt 60 provides further means to removably and rapidly secure the protective cover 10 to the shoe/boot 12 to assure that the cover 12 is not separated from the shoe/boot 12 when the cover 12 is contacted by a high speed cutting implement. The belt 60 may be used in conjunction with, or separately from, the attachment means 50.

Figure 3:
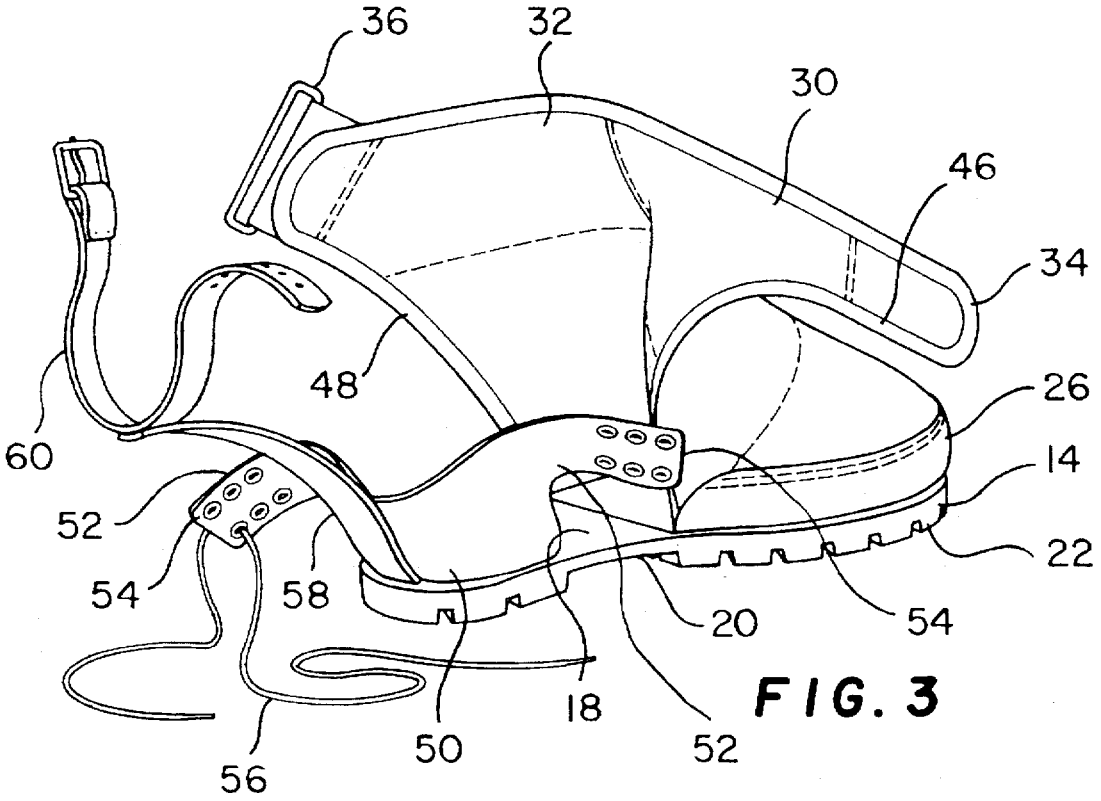
FIGS. 3–6 are a sequence showing disposition of the present invention on a boot.
Figure 4:
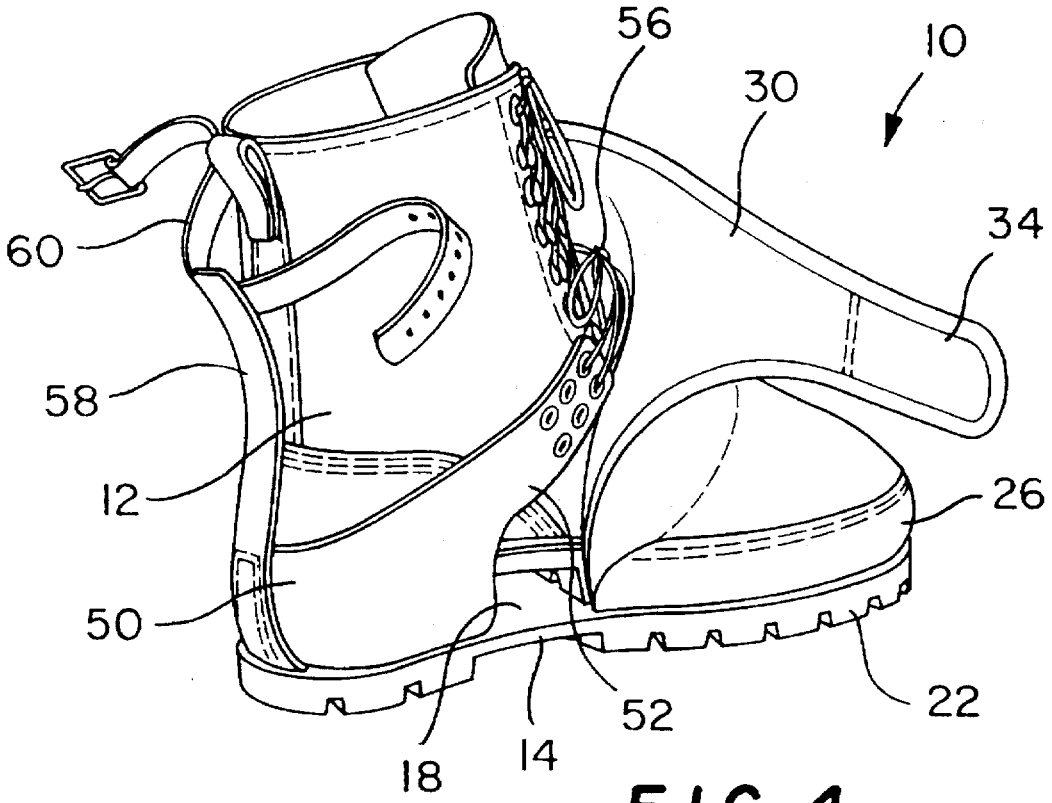
Figure 5:
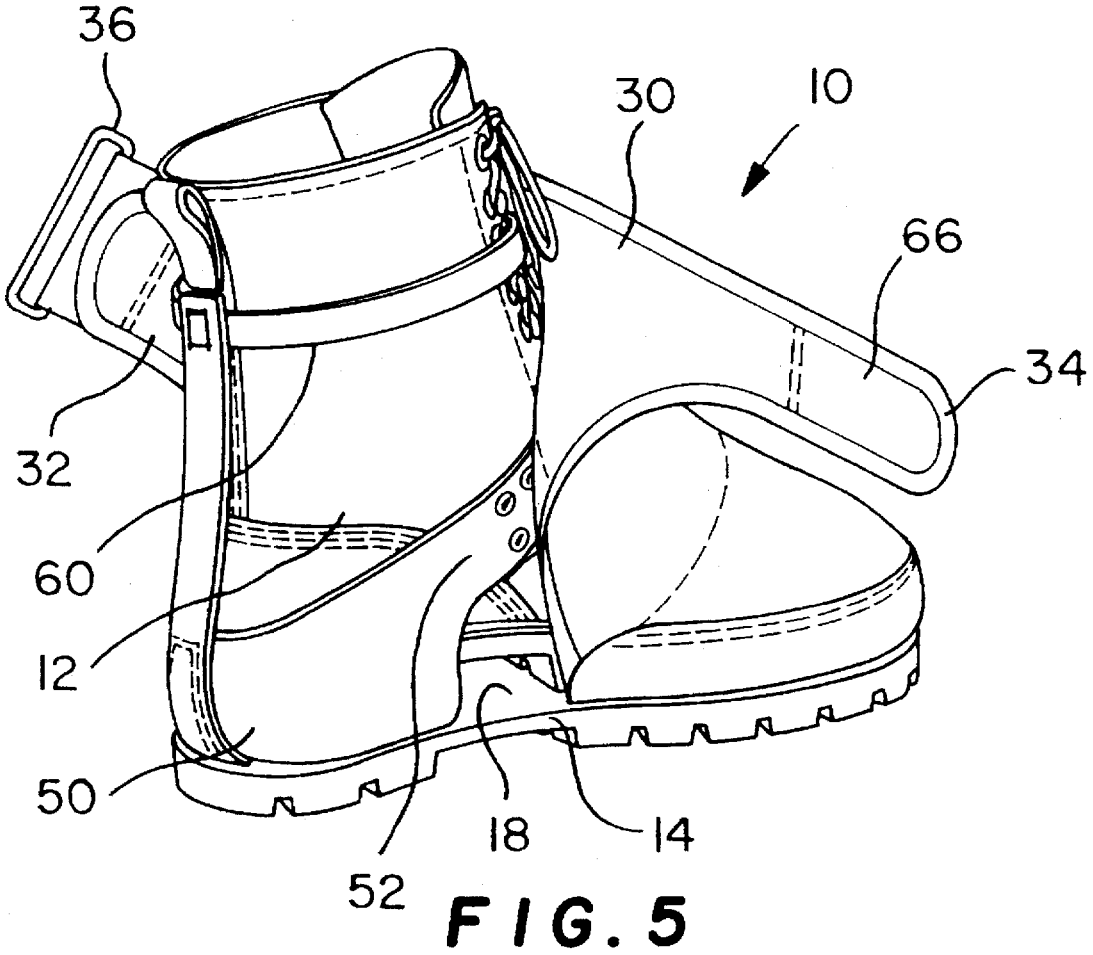
Figure 6:
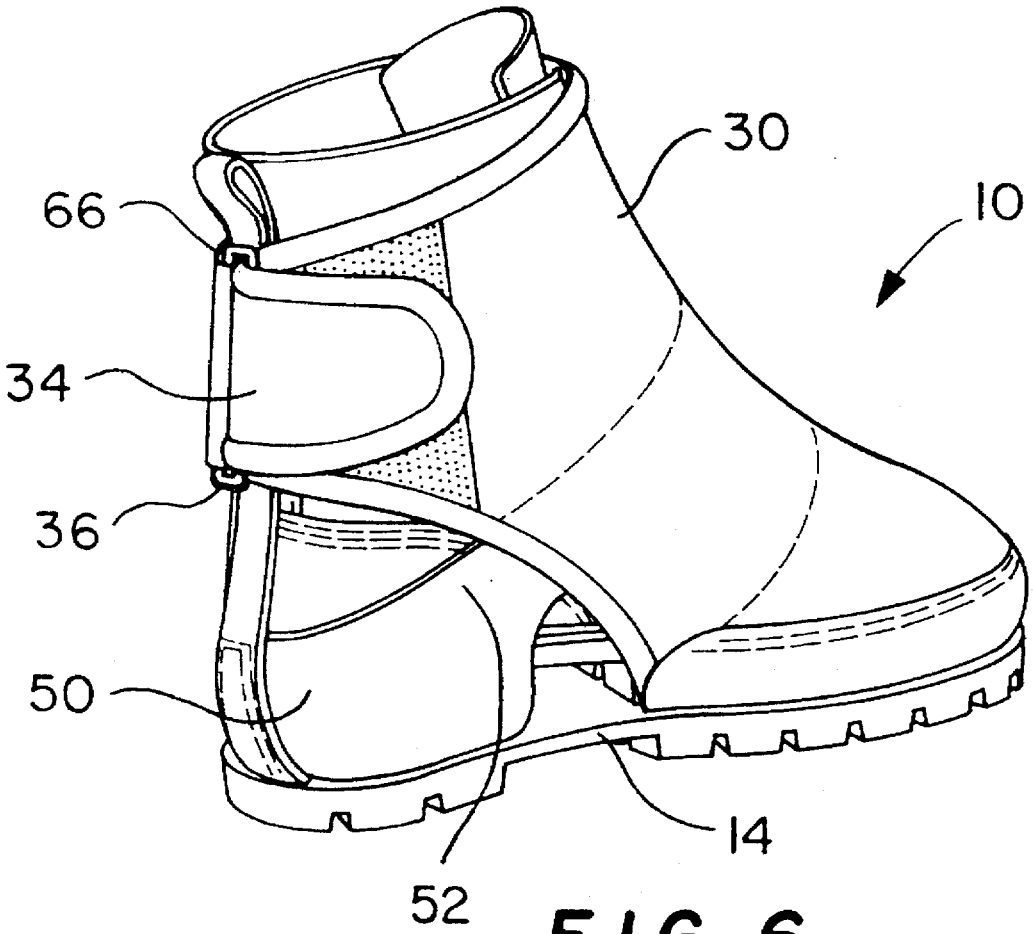

Having described the protective cover 10, the protective cover is slipped over a shoe/boot 12 in a method of use as shown in FIGS. 3–6. The toe of the shoe/boot 12 is disposed in the toe portion 26 of the protective cover 10 with the sole surface of the shoe/boot 12 in contact with the inner surface 18 of the sole member 14 (FIG. 3). The outer panel 30 and the inner panel 32 of the upper member 16 are folded away from the shoe/boot 12 so that there is access to connector means 56 to connect the straps means 52 to one another and secure the sole member 14 to the shoe/boot 12 (FIG. 4). The belt 60 is then secured around the shoe/boot 12 at approximately the ankle of the wearer and the inner panel 32 and the outer panel 30 are folded toward the back of the shoe/boot 12 (FIG. 5). The tab 34 on the outer panel 30 is inserted through the loop means 36 on the inner panel 32 and returned approximately 180° to the outer panel 30, thereby drawing the rearward portion of the upper member 16 snugly around the back of the shoe/boot 12. Preferably, the surface of the tab 34 and the surface of the outer panel 30 directly opposing the tab 34, have hook and loop fasteners 66 thereon for rapid connection and quick release. The tab 34 is attached to the outer panel 30 by means of the fasteners 66 and the securing of the protective cover 10 to the boot/shoe 12 is completed simply and rapidly. If desired, the tab 34 may be removably attached to the outer panel 30 using other types of fasteners such as buckles, snap fasteners etc. Also, a strap may be used in place of the tab 34 and loop means 36. The protective cover 10 completely covers the strap means 52 which are at approximately the instep of the shoe/boot 12 and the belt 60 which is approximately at the ankle of the shoe/boot 12. Thus, the means to fasten the protective cover 10 to the shoe/boot 12 is fully protected from the high speed cutting implement.

When worn as described, the sole member 14, inner surface 18, toe portion 26, instep 21, outer panel 30, and inner panel 32 are in contact with the respective sole surface, toe, instep, inner side and outer side of the shoe/boot 12.

The protective cover 10 is easily and rapidly removed from the shoe/boot by unattaching the tab 34, removing the tab 34 from the loop means 36, folding the outer panel 30 and the inner panel 32 toward the toe portion 26, opening the belt 60, opening the strap means 52 and slipping the protective cover 10 off of the shoe/boot 12.

The placement of the protective cover 10 on the shoe/boot 12 and removal from the shoe/boot 12 can be accomplished very rapidly and without any auxiliary tools.

Figure 7:
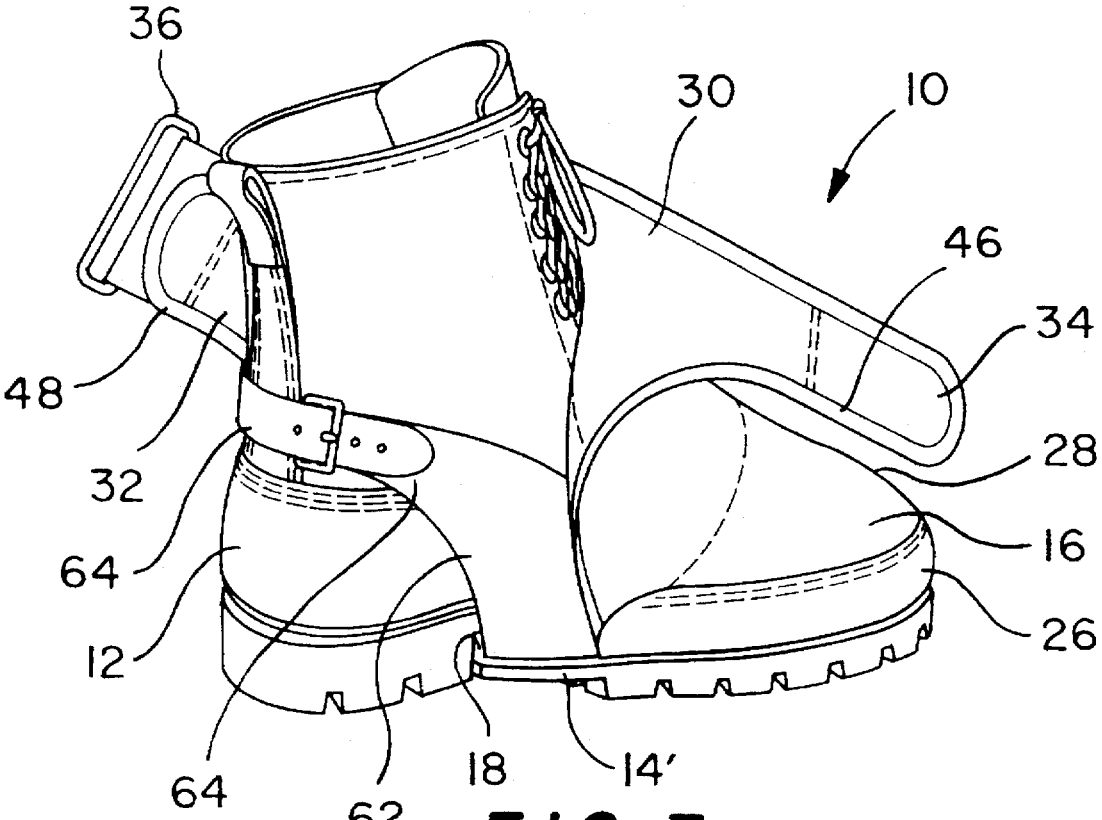
FIG. 7 is a perspective view of an alternate embodiment of the present invention having a partial sole attached to the boot by the straps with the upper member not being secured about the back of the boot.

In an alternate embodiment (FIGS. 7 and 8) the sole member 14' is a partial sole as compared to the embodiment previously disclosed. The inner surface 18 of the sole member 14' is in direct contact with the sole surface of the shoe/boot 12. The sole member 14' extends from the toe of the shoe/boot 12 to point approximately two-thirds to three-quarters of the distance between the toe and the back of the shoe. The sole member 14' extends approximately to the breast of the heel of the shoe/boot 12. The upper member 16 of the protective cover 10 is identical to the upper member as described above as attached to the full sole member with respect to the materials of construction and the design having a toe portion 26, an instep 28, an outer panel 30, an inner panel 32, a tab 34, a loop means 36, an outer layer 38, an inner layer 40, a lining means 42, a skirt 44, and edges 46 and 48.

Figure 8:
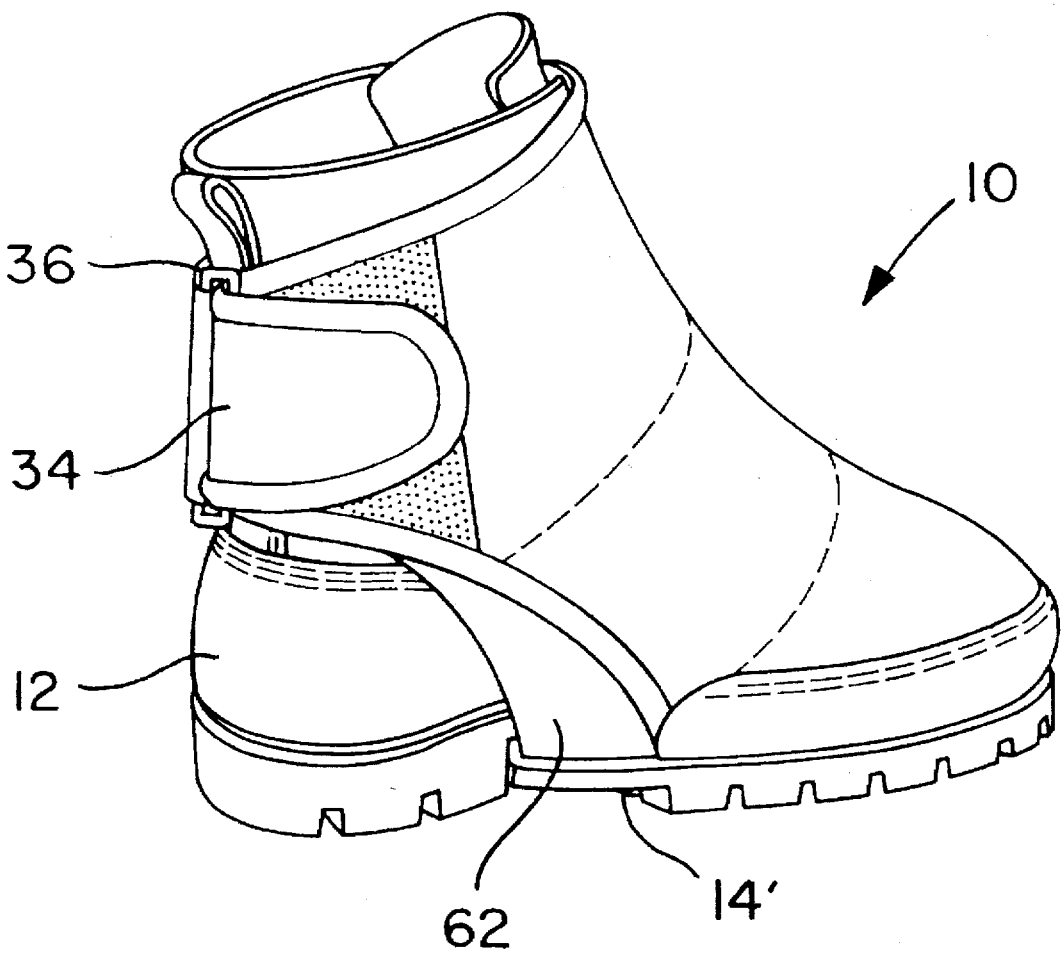
FIG. 8 is the embodiment of FIG. 7 completely attached to the boot.

However, in the alternate embodiment the attachment means 62 differs from the attachment means 50 for the full sole member 14. In the alternate embodiment, the attachment means 62 is connected to the sole member 14' distal from the toe portion 26. The attachment means 62 has a pair of strap means 64 formed thereon. The strap means 64 extend rearwardly on opposite sides of the shoe/boot 12. The respective ends of the strap means 64 have a buckle, snap, lace or hook and loop fastening means to permit the securing of the strap means 64 to one another against the back of the shoe/boot 12 and to retain the protective cover 10 to the shoe/boot 12. When the protective cover 12 is slipped over the shoe/boot 12, the attachment means 62 is completely protected from the high speed cutting implement (FIG. 8).

The alternate embodiment is placed on the shoe/boot 12 as previously described except that no belt is provided and the strap means 64 are fastened about the back of the shoe/boot 12.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A slip-on cover to protect feet and ankles of a person using a high speed cutting device, the slip-on cover being disposed over a shoe having a toe, an instep, a heel, a back, a sole surface, an outer side and an inner side, the slip-on cover comprising a sole member having an inner surface and an upper member attached to the sole member, the upper member being flexible and formed of multiple layers including an outer layer, an inner layer and a high modulus fiber lining means therebetween, the high modulus fiber lining means jamming the high speed cutting device in the event the high speed cutting device is brought into contact with the slip-on cover, the upper member having a toe portion, an instep, an outer panel and an inner panel, the outer panel having a rearwardly extending tab formed thereon, quick-release fastening means being provided between the tab and the inner panel of the upper member for securing the panels of the upper member around the back of the shoe, attachment means connected to the sole member, the attachment means releasably attaching the slip-on cover to the shoe, the attachment means being covered by the upper member of the slip-on cover, wherein the shoe is removably received and secured within the slip-on cover such that the sole member inner surface, toe portion instep, inner panel and outer panel of the slip-on cover are in contact with the respective sole surface, toe, instep, inner side and outer side of the shoe, whereby the slip-on cover is precluded from being separated from the shoe upon contact between the high speed cutting device and the slip-on protective cover, and the attachment means are protected from the high speed cutting device.

2. The slip-on cover of claim 1, wherein the sole member is a full sole such that when the shoe is received in the slip-on cover, contact between the sole inner surface of the slip-on cover and the sole surface and heel of the shoe extends from the toe of the shoe to the back of the shoe.

3. The slip-on cover of claim 1, wherein the sole member is a partial sole such that when the shoe is received in the slip-on cover, the inner surface of the sole member of the slip-on cover is in contact with the sole surface of the shoe from the toe to a point approximately 70% of a distance between the toe and the back of the shoe.

4. The slip-on cover of claim 1, wherein the sole of the slip-on cover has an outer surface, said outer surface having a plurality of calks mounted thereon to provide improved traction for the person wearing the slip-on cover.

5. The slip-on cover of claim 1, further comprising a loop means secured to the inner panel of the upper member such that the tab on the outer panel may be pulled through the loop means and folded back approximately 180° and fastened to the outer panel, whereby the upper member is secured to the ankle of the person.

6. The slip-on cover of claim 1, wherein the high modulus fiber lining means is para aramid.

7. The slip-on cover of claim 1, wherein the high modulus fiber lining means is a polyethylene/polypropylene composite.

8. The slip-on cover of claim 1, wherein the high modulus fiber lining means is a plurality of layers.

9. The slip-on cover of claim 1, wherein the attachment means is a pair of strap means attached to the sole member of the slip-on cover, each strap means extending from the sole member on opposite sides thereof, each strap means having an end, connector means being provided to connect the ends of the pair of strap means to one another such that sole member is releasably attached to the shoe and the upper member of the slip-on cover is disposed over the connector means.

10. The slip-on cover of claim 1, further comprising a strip attached approximately perpendicularly to a back edge of the sole member of the slip-on cover, the strip extending upwardly to the upper member, a belt being connected to the strip, means being provided to releasably fasten the belt around the ankle of the wearer such that when the slip-on cover is disposed over the shoe, the belt is covered by the upper member of the protective cover.

11. The slip-on cover of claim 1, wherein the upper member is sewed to the sole member.

12. The slip-on cover of claim 1, further comprising a skirt attached to the multiple layers of the upper member, the skirt also being connected to the sole member.

13. A slip-on cover to protect the feet of a person using a high speed cutting device, the slip-on cover being disposed over a boot having a toe, a sole and a back, the slip-on cover comprising a sole member and an upper member, the sole member being in contact with the sole of the boot, the upper member being flexible and formed of a skirt and a multiple of layers, at least one of the layers being a high modulus fiber, the high modulus fiber jamming the high speed cutting device in the event the high speed cutting device is brought in contact with the high modulus fiber, the skirt being attached to the multiple layers and also being attached to the sole member, means for releasably connecting the upper member around the back of the shoe and means for releasably fastening the sole member around the boot such that the slip-on cover is in contact with the respective sole, toe and back of the boot, the upper member covering the means for releasably fastening the sole member around the boot, wherein the slip-on cover is precluded from being separated from the boot upon contact between the high speed cutting device and the slip-on protective cover and the means for releasably fastening the sole member around the boot is protected from the high speed cutting device.

14. The slip-on cover of claim 13, wherein the sole member is a full sole such that when the boot is disposed in the slip-on cover, contact is made between an inner surface of the sole member and the sole of the boot extending from the toe of the boot to the back of the boot.

15. The slip-on cover of claim 13, wherein the sole member is a partial sole such that when the boot is disposed in the slip-on cover, an inner surface of the sole member is in contact with the sole of the boot from the toe of the boot to a point approximately 70% of a distance between the toe and the back of the boot.

16. The slip-on cover of claim 13, wherein the means for releasably fastening the sole member around the boot comprises a pair of strap means attached to the sole member, the strap means extending from the sole member on opposite sides thereof, the strap means being releasably fastened to each other to secure the sole member to the boot.

17. The slip-on cover of claim 13, wherein the means for releasably fastening the sole member comprises a strip attached approximately perpendicularly to a back edge of the sole member, the strip extending upwardly to the upper member, a belt being connected to the strip, means being provided to releasably fasten the belt around the ankle of the wearer such that when the slip-on cover is disposed over the boot, the belt is covered by the upper member of the protective cover.

18. A slip-on cover to protect feet and ankles of a person using a high speed cutting device, the slip-on cover being disposed over a shoe having a toe, a sole and a back, the slip-on cover comprising a sole member and an upper member attached to the sole member, the shoe being disposed therebetween, the upper member being flexible and formed of multiple layers including a high modulus fiber lining, the upper member having a toe portion, an instep, an outer panel and an inner panel, the outer panel having a rearwardly extending tab formed thereon, quick-release fastening means being provided between the tab and the inner panel of the upper member for securing the panels of the upper member around the shoe, attachment means connected to the sole member for releasably attaching the slip-on cover to the shoe, the attachment means being covered by the upper member of the slip-on cover, wherein the shoe is removably received and secured within the slip-on cover such that the sole member, toe portion, instep, inner panel and outer panel of the slip-on cover are in contact with the respective sole, toe and back of the shoe, and the attachment means are protected from the high speed cutting device.

19. The slip-on cover of claim 18, wherein the means for releasably attaching the slip-on cover to the shoe comprises a pair of strap means attached to the sole member, each strap means extending from the sole member on opposite sides thereof, the strap means being releasably fastened to each other.

20. The slip-on cover of claim 18, wherein the means for releasably attaching the slip-on cover to the shoe comprises a strip attached approximately perpendicularly to a back edge of the sole member and extending upwardly to the outer panel, a belt being connected to the strip, means being provided to releasably fasten the belt around the ankle of the wearer such that when the slip-on cover is disposed over the boot, the belt is covered by the upper member of the protective cover.

21. The slip-on cover of claim 18, wherein the sole of the slip-on cover has an outer surface, said outer surface having a plurality of calks mounted thereon to provide improved traction for the person wearing the slip-on cover.

22. The slip-on cover of claim 18, further comprising a loop means secured to the inner panel of the upper member such that the tab on the outer panel may be pulled through the loop means and folded back approximately 180° and fastened to the outer panel, whereby the upper member is secured to the ankle of the person.

23. The slip-on cover of claim 18, wherein the high modulus fiber lining is para aramid.

24. The slip-on cover of claim 18, wherein the high modulus fiber lining is a polyethylene/polypropylene composite.

25. The slip-on cover of claim 18, wherein the high modulus fiber lining is a plurality of layers.

* * * * *